US007197996B2

(12) United States Patent
Suh

(10) Patent No.: US 7,197,996 B2
(45) Date of Patent: Apr. 3, 2007

(54) SEAT BOARD FOR BOARD KITING

(76) Inventor: Sungjun Suh, Room 1807, N-City Officetel, 59-2 Shingil 1-dong, Yeongdeungpo-gu, Seoul (KR)

( * ) Notice: Subject to any disclaimer, the term of this patent is extended or adjusted under 35 U.S.C. 154(b) by 104 days.

(21) Appl. No.: 10/891,786

(22) Filed: Jul. 15, 2004

(65) Prior Publication Data

US 2005/0011425 A1 Jan. 20, 2005

(30) Foreign Application Priority Data

Jul. 18, 2003 (KR) ..... 2003-23280

(51) Int. Cl.
*B63H 9/00* (2006.01)

(52) U.S. Cl. ..... 114/39.12; 114/39.14; 114/102.11

(58) Field of Classification Search ..... 114/39.12, 114/39.14, 102.11, 93, 90
See application file for complete search history.

(56) References Cited

U.S. PATENT DOCUMENTS 4,526,120 A * 7/1985 Gaide ..... 114/39.12
4,589,365 A * 5/1986 Masters ..... 114/347
4,738,414 A 4/1988 McCulloh
5,054,854 A * 10/1991 Pruit ..... 297/284.3
5,366,182 A 11/1994 Roeseler et al.
5,377,607 A * 1/1995 Ross ..... 114/39.12
5,489,228 A * 2/1996 Richardson et al. ..... 441/74
6,923,131 B2 * 8/2005 Petrovich ..... 114/39.26
2002/0162493 A1 * 11/2002 Hoyt ..... 114/102.18

FOREIGN PATENT DOCUMENTS

EP 1 241 090 A2 9/2002
WO WO 02/079030 A1 10/2002
WO WO 2005/007501 A1 1/2005

* cited by examiner

*Primary Examiner*—Ed Swinehart
(74) *Attorney, Agent, or Firm*—JHK Law; Joseph Hyosuk Kim

(57) ABSTRACT

The present invention discloses a seat board for board kiting that is made of a substantially high durability of material, having a seating recess thereon, thereby permitting a rider to enjoy the board kiting in a convenient way. The seat board for board kiting that has a seating recess formed at an upper central portion thereof, is in a shape of a generally small boat and has a kite fixed thereto to thereby obtain a propelling force, the seat board including: a body made of a polystyrene foam material; a resin layer made of fiber glass and formed on the external surface of the body for preventing the damage caused upon collision of the body against an external object; and kite fixing means provided slidably in the seating recess for fixing the kite.

6 Claims, 5 Drawing Sheets

SEAT BOARD FOR BOARD KITING

BACKGROUND OF THE INVENTION

1. Field of the Invention

The present invention relates to a seat board for board kiting, and more particularly, to an improved seat board for Korean Patent Application No. 2003-28688 entitled "Kite System with Seat Board" as previously filed by the same applicant as this invention.

2. Background of the Related Art

FIG. 1 is a view showing a kite sail board system with a conventional seat board, which is of course illustrated in the prior art as previously filed by the same applicant as this invention. As shown in FIG. 1, the kite sail board system for a rider comprises: a seat board 1 having a cavity provided with an upper face that is opened and a lower face, the cavity having a seat face 1*a* disposed therein, the seat face 1*a* on which the rider sits; a kite 2; and one or more connecting strings 2*a* connected with the kite 2, the strings 2*a* being held by the rider for controlling the movement of the seat board 1, such that the kite 2 provides a propelling force to the rider and the seat board 1.

According to the kite sail board system as constructed above, in a state where the rider sits on the seat face 1*a* of the seat board 1, he or she obtains the propelling force from the kite 2 such that the seat board 1 is moved forwardly.

In the conventional kite sail board system, the seat board 1 is provided just with the seat face 1*a* on which the rider sits, but it does not have any means for fixing the kite.

SUMMARY OF THE INVENTION

Accordingly, the present inventor has been made to solve the above-described problems, and it is an object of the present invention to provide a seat board for board kiting that is made of a substantially high durability of material and has a seating recess formed thereon, thereby permitting a rider to enjoy the board kiting in a more convenient way.

To accomplish the above object, according to a first aspect of the present invention, there is provided a seat board for board kiting which has a seating recess formed at an upper central portion thereof, is in a shape of a generally small boat and has a kite fixed thereto to thereby obtain a propelling force, the seat board including: a body made of a polystyrene foam material; a resin layer made of fiber glass and formed on the external surface of the body for preventing the damage caused upon collision of the body against an external object; and kite fixing means provided slidably in the seating recess for fixing the kite.

The kite fixing means includes a fixing bar secured in the seating recess and having a sliding groove formed along the longitudinal direction thereof, a movable member movably coupled to the sliding groove at the bottom portion thereof and having a coupling hole formed at the top end portion thereof, and a hook member screw-coupled to the coupling hole of the movable member at one end portion thereof and connected to the kite at the other end portion thereof.

To accomplish the above object, according to a second aspect of the present invention, there is provided a seat board for board kiting which has a seating recess formed at an upper central portion thereof, is in a shape of a generally small boat and has a kite fixed thereto to thereby obtain a propelling force, the seat board including: a body made of a polystyrene foam material; a resin layer made of fiber glass and formed on the external surface of the body for preventing the damage caused upon collision of the body against an external object; a fixing bar secured in the seating recess and having a sliding groove formed therein along a longitudinal direction thereof; a movable member movably coupled to the sliding groove at the bottom portion thereof and having a coupling hole formed at the top end portion thereof; and a mast coupled with a sail along a longitudinal direction thereof and detachably mounted to the coupling groove of the movable member.

Preferably, the seating recess is provided with a back rest that is formed of an air tube.

Preferably, the seating recess is provided with a through-hole formed at the inside thereof, respectively, for permitting water from the outside to be passed therethrough.

Preferably, the seating recess is provided with a space portion at either front or back portion thereof.

Preferably, the body is provided with a curved face formed at the bottom surface thereof along a longitudinal direction thereof.

Preferably, the body is formed flat at the bottom surface thereof and directed upwardly at the front surface thereof.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
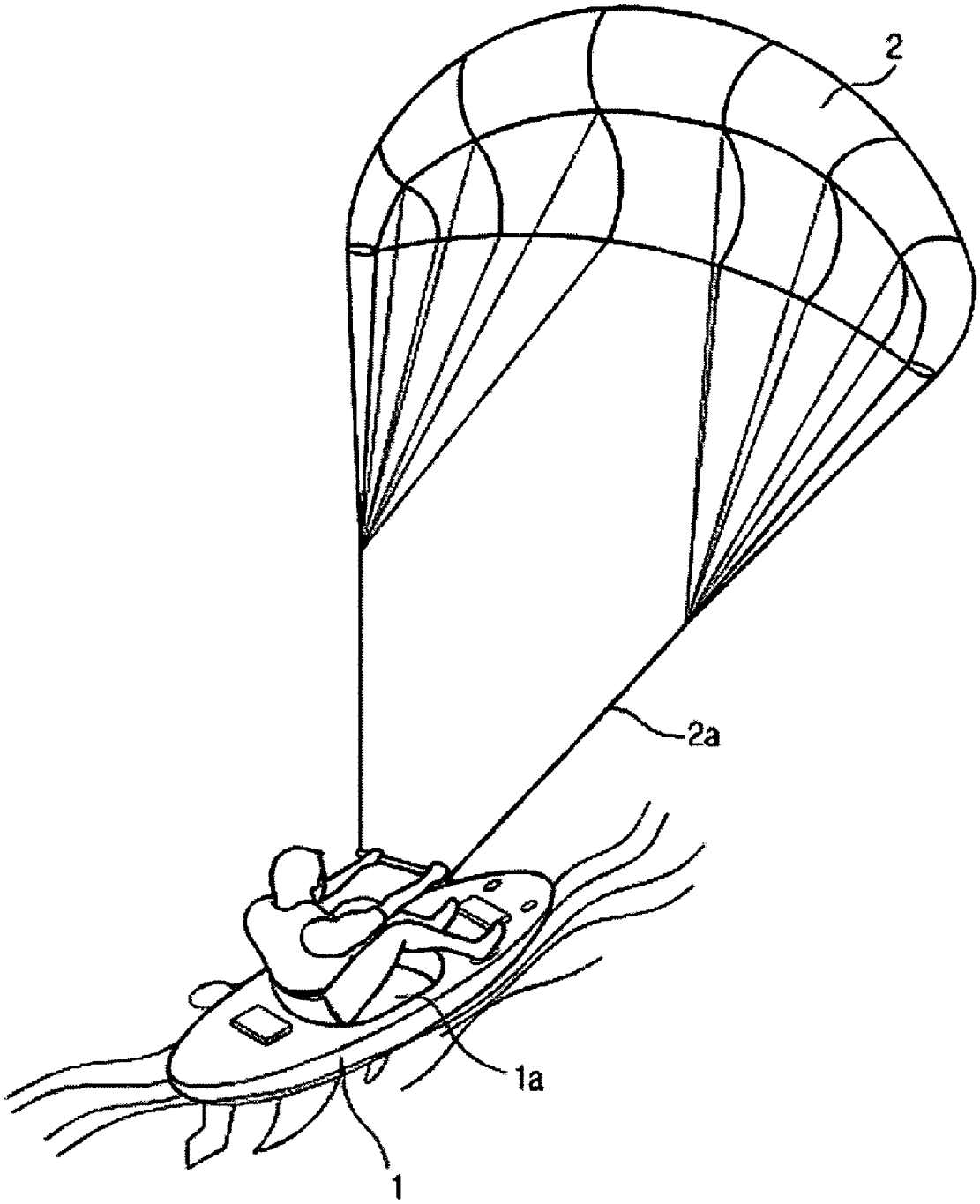
FIG. 1 is a view of describing a kite system with a conventional seat board.
Figure 2:
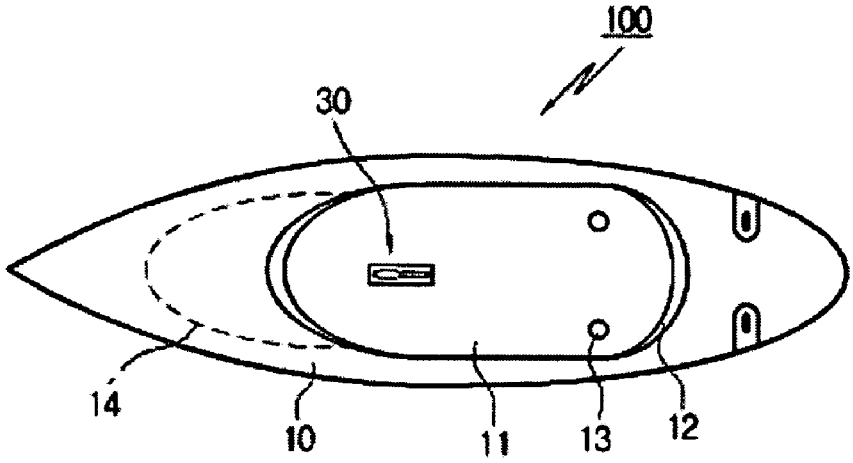
FIG. 2 is a plan view of a seat board for board kiting according to the present invention.
Figure 3:
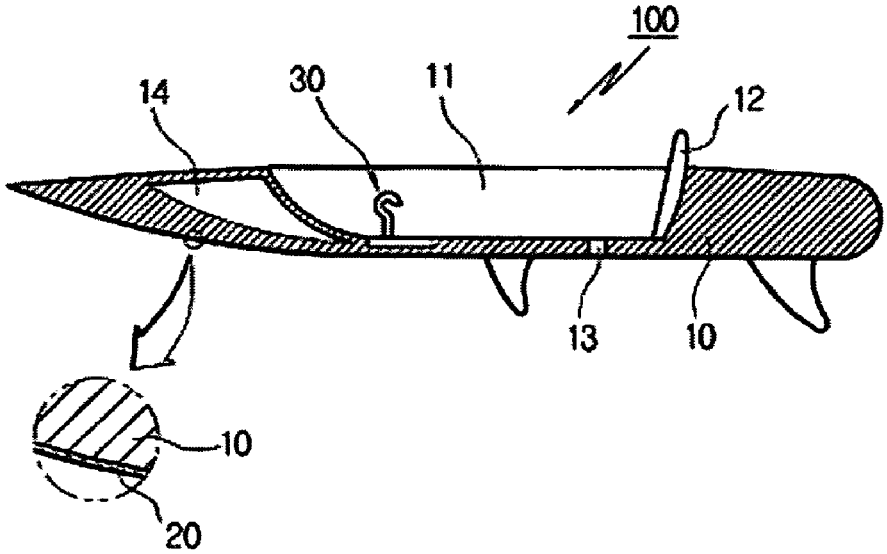
FIG. 3 is a side view of the seat board of this invention.
Figure 4:
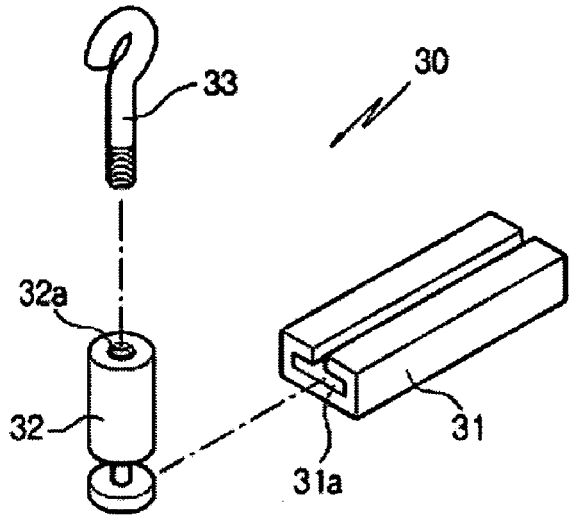
FIG. 4 is a perspective view of kite fixing means of the seat board of this invention.
Figure 5:
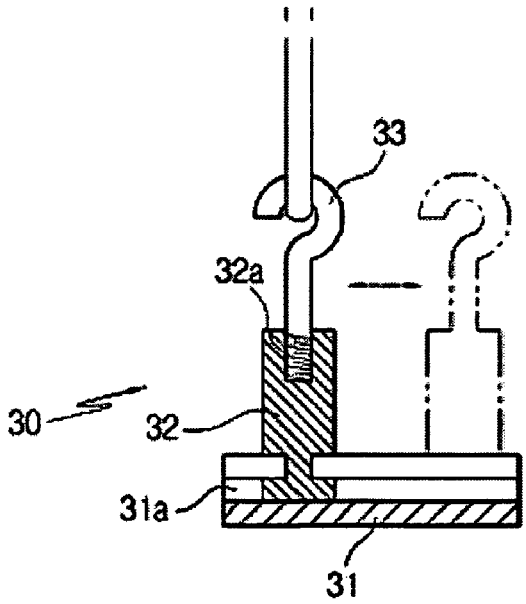
FIG. 5 is a sectional view showing the movement of the kite fixing means of the seat board of this invention.

Now, an explanation on the preferred embodiments of the present invention will be in detail given with reference to attached drawings.

FIGS. 2 to 7 show a seat board 100 for board kiting according to the present invention.

As shown, the seat board 100 for board kiting has a seating recess 11 at an upper central portion thereof, being in a shape of a generally small boat and has a kite (not shown) fixed thereto to thereby obtain a propelling force, the seat board 100 including: a body 10 made of a polystyrene foam material; a resin layer 20 made of fiber glass and formed on the external surface of the body 10 for preventing the damage caused upon collision of the body 10; and kite fixing means 30 provided slidably in the seating recess 11 for fixing the kite.

The kite fixing means 30 includes a fixing bar 31 secured in the seating recess 11 and having a sliding groove 31*a* formed therein along the longitudinal direction thereof, a movable member 32 movably coupled to the sliding groove 31*a* at the bottom portion thereof and having a coupling hole

32*a* formed at the top end portion thereof, and a hook member 33 screw-coupled to the coupling hole 32*a* of the movable member 32 at one end portion thereof and connected to the kite at the other end portion thereof.

In other words, if the connecting string of the kite is fixed to the hook member 33, the movable member 32 that is coupled to the hook member 33 becomes slid along the sliding groove 31*a* of the fixed bar 31, thereby providing a propelling force to the seat board 100.

The seat board 100 is substantially large to such a size as to prevent the overturning due to great waves, with a result that a rider enjoys his or her kiting on the water in an easy and safe manner at a state of sitting thereon, and also, the seating recess 11 is large to such a depth as to place the central point of gravity of the rider when he sits thereon under his abdominal region.

As the rider controls a sailing direction with the pushing force by using his feet during the sailing for long hours, his back region becomes tired. To relieve his fatigue, the seating recess 11 of the seat board 100 is provided with a back rest 12 that is formed of an air tube for supporting the rider's back region. While the rider is taking a rest during the sailing, besides, he may use the back rest 12 as a pillow.

Also, the seating recess 11 of the seat board 100 is provided with a through-hole 13 at both back sides in the inside thereof, respectively, such that a predetermined quantity of water is charged in the seating recess 11 to thereby prevent the seat board 100 from being overturned during the sailing and also, the water from the outside is permitted to be passed therethrough.

Furthermore, the seating recess 11 of the seat board 100 is provided with a space portion 14 at either front or back portion thereof, for keeping an emergency paddle or food and drinks therein.

The emergency paddle is prepared for stopping the wind during the sailing or for the time when the sailing is stopped due to entering the calm belt.

Figure 6:
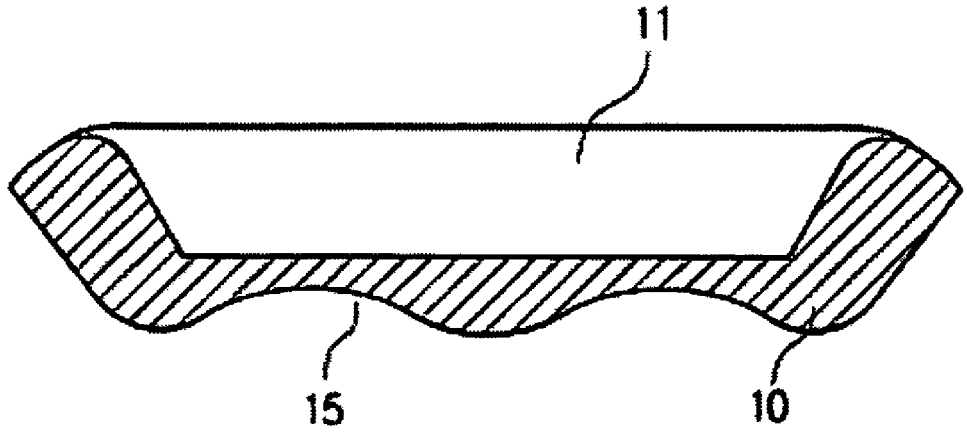
FIG. 6 is a view showing an embodiment of a body of the seat board of this invention.

FIG. 6 is a view showing an embodiment of the body 10 of the seat board 100 of this invention, wherein the body 10 is provided with a curved face 15 formed at the bottom surface thereof along a longitudinal direction thereof, which allows elementary and intermediate level of riders to use it in a more safe way.

The curved face 15 is formed along the longitudinal direction of the body 10, which gives stability rather than rapid speed.

Figure 7:
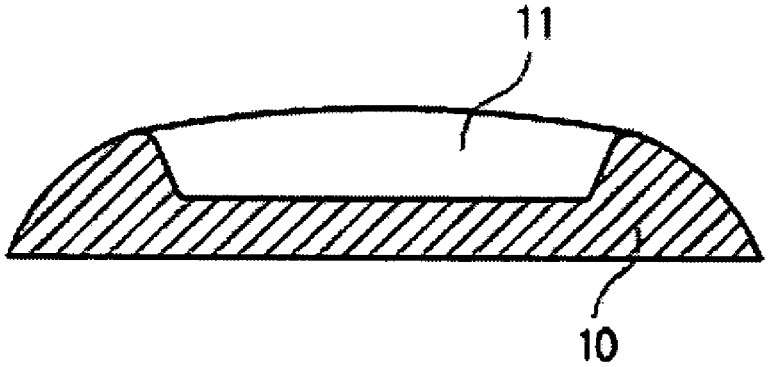
FIG. 7 is a view showing another embodiment of the body of the seat board of this invention.

FIG. 7 is a view showing another embodiment of the body of the seat board of this invention, wherein the body 10 is formed flat at the bottom surface thereof and directed upwardly at the front surface thereof, which allows high level of riders to enjoy substantially high speed during sailing.

Figure 8:
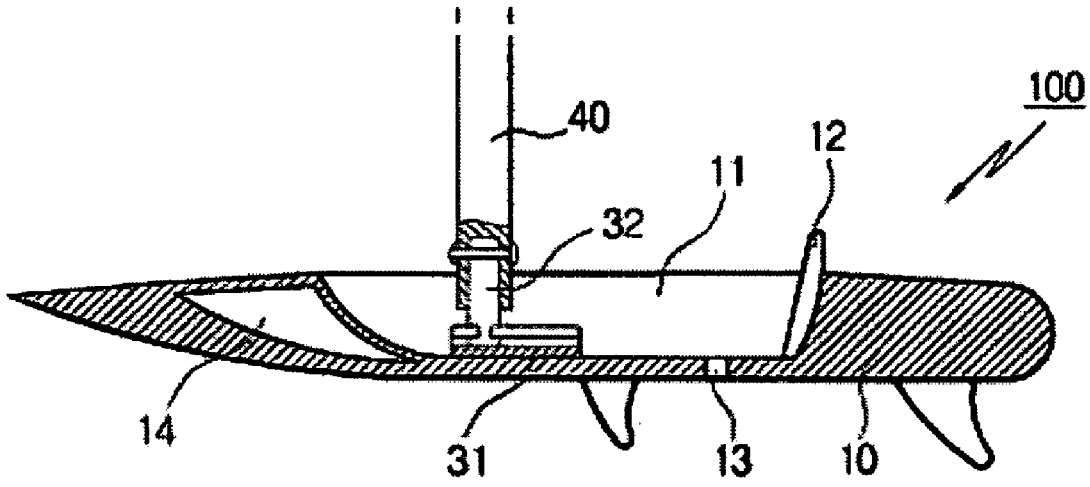
FIG. 8 is a side view showing the state where a mast is mounted at the seat board of this invention.

FIG. 8 is a side view showing the state where a mast is mounted at the seat board of this invention wherein the parts corresponding to those of the aforementioned seat board are indicated by corresponding reference numerals, and therefore, an explanation of them is avoided for the brevity of description.

In this embodiment, the kite is replaced with a mast 40, and other parts are the same as of the aforementioned seat board.

In more detail, the kite fixing means 30 is coupled not with the hook member 33, but with the mast 40 that is coupled a sail (not shown) along the longitudinal direction thereof and is detachably inserted into the coupling hole 32*a* of the movable member 32 at one end portion thereof.

If the mast 40 is coupled to the seat board 100, the sailing is just carried out.

Now, an explanation of the operation of the seat board for board kiting according to the present invention will be in detail given.

A kite is mounted by means of the kite fixing means 30 that is provided in the seating recess 11 of the seat board 100, and then, the board kiting is done.

At that time, the kite is coupled to the movable member 32 and the hook member 33 that are disposed slidably on the fixing bar 31, such that a rider controls the driving direction of the kite in accordance with the direction of the wind.

The back rest 12 that is made of the air tube is mounted in the seating recess 11 such that the rider does not feel tired on his back region, and the back rest 12 is also utilized as a pillow while he is taking a rest during sailing.

Moreover, when the sailing is stopped due to entering the calm belt, the emergency paddle that is kept in the space portion 14 is used.

The water in the seat board 100 is passed through the through-holes 13 that are formed in the seating recess 11, such that the seat board 100 can be driven in a safer manner.

On the other hand, if the hook member 33 that is fixed for board kiting is removed for coupling the mast 40 with the movable member 32, the sailing can be continued by the use of the sail on the mast 40.

As set forth in the foregoing, the seat board for boarding kiting according to the present invention is provided with the body that is made of a polystyrene foam material and the resin layer that is made of fiber glass and covered on the external face of the body, thereby improving the durability.

The seat board is further provided with the kite fixing means, the space portion, and the mast, thereby enabling a rider to enjoy the board kiting in more convenient manner.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A seat board for board kiting which has a seating recess formed at an upper central portion thereof, is in a shape of a generally small boat and has a kite fixed thereto to thereby obtain a propelling force, the seat board comprising:

a body made of a polystyrene foam material;

a resin layer made of fiber glass and formed on the external surface of the body for preventing the damage caused upon collision of the body against an external object; and kite fixing means provided slidably in the seating recess for fixing the kite, wherein the kite fixing means comprises:

a fixing bar secured in the seating recess and having a sliding groove formed along a longitudinal direction thereof;

a movable member movably coupled to the sliding groove at the bottom portion thereof and having a coupling hole formed at the top end portion thereof; and a hook member screw-coupled to the coupling hole of the movable member at one end portion thereof and connected to the kite at the other end portion thereof.

2. A seat board according to claim 1, wherein the seating recess is provided with a back rest that is formed of an air tube.

3. A seat board according to claim 1, wherein the seating recess is provided with a through-hole formed at the inside thereof, for permitting water from the outside to be passed therethrough.

4. A seat board according to claim 1, wherein the seating recess is provided with a space portion at either front or back portion thereof.

5. A seat board according to claim 1, wherein the body is provided with a curved face formed at the bottom surface thereof along a longitudinal direction thereof.

6. A seat board according to claim 1, wherein the body is formed flat at the bottom surface thereof and directed upwardly at the front surface thereof.

* * * * *